United States Patent [19]

Smith

[11] 3,984,027

[45] Oct. 5, 1976

[54] FOOD SERVICE PACKAGE

[75] Inventor: G. Kenneth Smith, Waterville, Ohio

[73] Assignee: Owens-Illinois, Inc., Toledo, Ohio

[22] Filed: Dec. 15, 1975

[21] Appl. No.: 640,658

[52] U.S. Cl. ..... 220/306; 220/3.1; 229/43; 229/2.5 R; 150/.5

[51] Int. Cl.[2] ..... B65D 43/02

[58] Field of Search ..... 220/306, 3.1, 307, 4 R, 220/4 B; 229/43, 2.5; 150/.5

[56] References Cited

UNITED STATES PATENTS

| | | | |
|---|---|---|---|
| 3,902,540 | 9/1975 | Commisso | 229/2.5 X |
| 3,935,962 | 2/1976 | Schubert et al. | 220/306 |

*Primary Examiner*—George T. Hall

*Attorney, Agent, or Firm*—David R. Birchall; Edward J. Holler; Steve M. McLary

[57] ABSTRACT

An improved two piece food package. The package includes lid and dish members. The lid has formed in its perimeter three slots, two on one side and a single slot on the opposite side. The dish member has three locking tabs designed to engage the slots in the lid to thereby hold the two members together as a unit package. Under the single tab is formed a locking lug. The locking lug extends outward far enough to interfere with a portion of the lid when the lid and dish are assembled. This interference causes the dish sidewall to bow, creating a lock of the dish sidewall into corners of the lid.

5 Claims, 9 Drawing Figures

FOOD SERVICE PACKAGE

BACKGROUND OF THE INVENTION

This invention generally relates to food service packages. More particularly, this invention relates to two piece food service packages having lid and dish members. Yet more particularly, this invention relates to such packages which are held together as a unit by the engagement of mating slots and tabs. Specifically, this invention relates to such a package wherein a lock lug is formed under one tab to bow the dish member to cause a force fit of lid and dish to relieve vertical forces on the tabs and slots.

Food service packages which have dish and lid members held together by the engagement of mating slots and tabs are not unknown in the art. These packages presented a problem in that, when filled, they directed the entire weight of the contents through the tabs when picked up. This led to failure of the package by the tabs slipping out of the slots or breaking off. The problem was that the entire load component was vertical. To deal with this, the tabs were made oversized or much thicker than the rest of the package had to be. This was quite wasteful of material. I have discovered that this problem may be overcome by placing a lock lug under one tab. This lug is sized to interfere with the lid when the package is assembled. This bows or stresses the dish, and forces the dish into wedging or forced engagement with corners of the lid. This, along with the engagement of the lug with the lid, provides a significant horizontal force component to help reduce the vertical forces placed on the tabs when the filled package is picked up.

SUMMARY OF THE INVENTION

My invention is a two piece food service package made of a relatively thin, flexible material. One part of the package is a lid member which includes a top panel. A depending perimetric skirt is attached to the top panel. An outwardly extending perimetric flange is attached to the free end of the skirt. A first slot is formed in the skirt. Second and third slots are also formed in the skirt in that portion of the skirt opposite the first slot. The second part of the package is a dish member which includes a bottom panel. An upstanding perimetric wall is attached to the bottom panel. An outwardly extending perimetric flange is attached to the free end of the perimetric wall. The dish flange has a perimeter and shape to allow it to fit within the perimeter of the top panel. This allows the top panel to rest on the dish flange when the package is assembled. A first outwardly extending locking tab is attached to the free edge of the flange. This tab is positioned to engage the first slot when dish and lid are assembled. Second and third outwardly extending locking tabs are also attached to the free edge of the dish flange and are positioned to engage, respectively, the second and third slots when the dish and lid are assembled. A pressure lock lug is positioned under the first locking tab and extends upwardly from the upstanding wall. The upper portion of the pressure lock lug merges with the underside of the first locing tab. The pressure lock lug extends outwardly further than the dish flange. Thus, when the lid and dish are assembled, the pressure lock lug will bend the dish wall and dish flange to engage the corners of the lid.

DETAILED DESCRIPTION OF THE DRAWINGS

Figure 1:
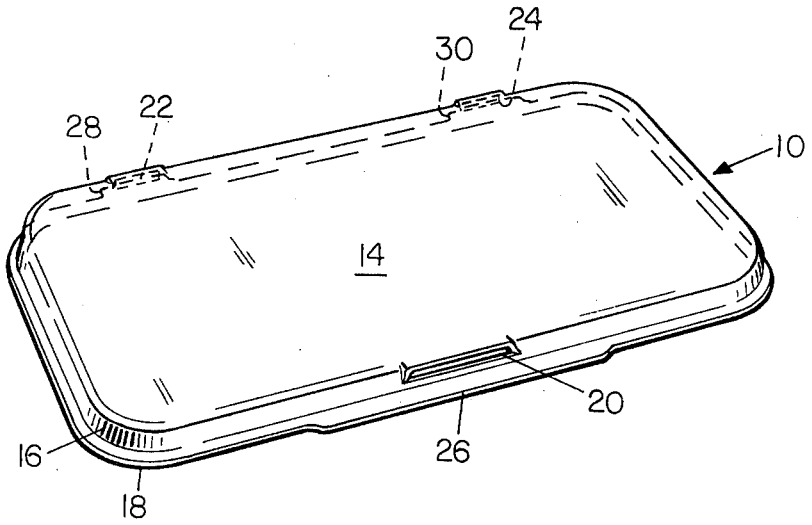
FIG. 1 is a top perspective view of the lid member of the present invention.
Figure 2:
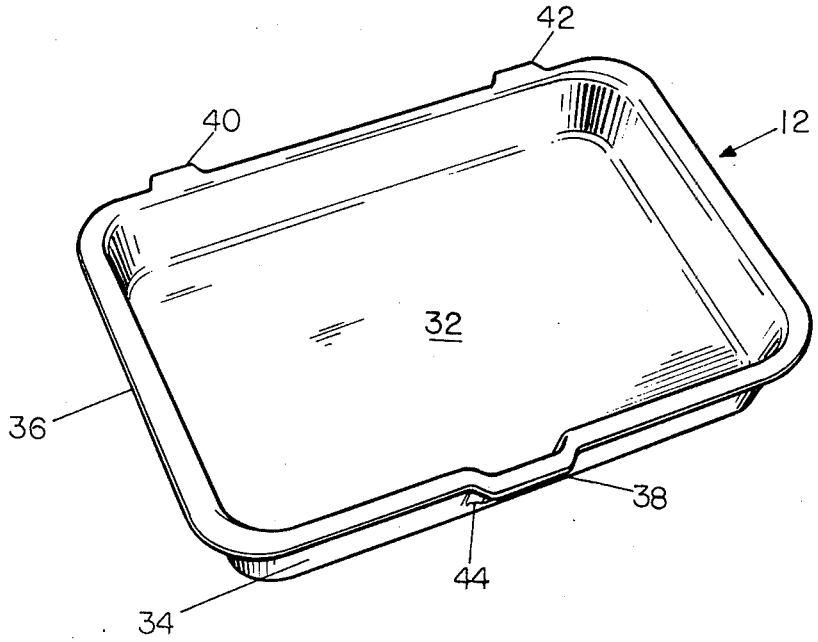
FIG. 2 is a top perspective view of the dish member of the present invention.
Figure 3:
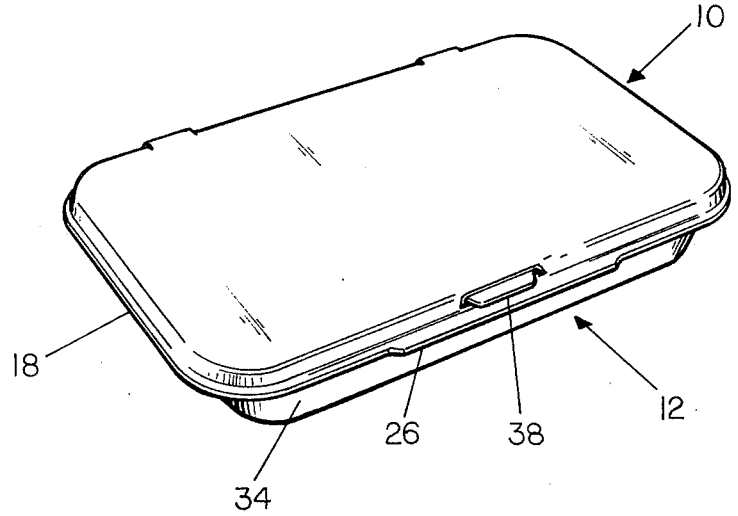
FIG. 3 is a perspective view of the assembled package of the present invention.

FIGS. 1, 2 and 3 show the present invention in separated and assembled configurations. The food package is a two piece assembly having a lid 10 and a dish 12. The details of construction which make this package a superior unit to any known in the prior art will be shown in the following detailed, fragmentary views. The first drawing figures do show the overall appearance of the package. The depth of the dish portion 12 may be varied, depending upon the type of food to be served. The rather shallow design illustrated herein could be used for carry out breakfact service, for example. However, the invention is not limited nor in any way dependent upon this particular dimension. Both the lid 10 and dish 12 are preferably molded as unitary pieces of a relatively thin, flexible material. This material is also preferably a thermally insulating material. Foam polystyrene is one example of a suitable material, and the thickness of the package sidewalls would be on the order of fifty to one-hundred thousandths of an inch. The package could also be made from a non-foam sheet like thermoplastic material. In this case, the wall thickness might be as small as twenty-five thousandths of an inch.

The lid 10 in FIG. 1 includes a top panel 14 and a depending perimetric skirt 16 attached thereto. The free end of the skirt 16 ends in an outwardly extending flange 18. Three locking slots are formed in the skirt 16. There is a first, centrally disposed slot 20. The other locking slots 22 and 24 are formed in the skirt 16 in the section of the skirt 16 opposite that in which the slot 20 is formed. The slots 22 and 24 are actually hidden in FIG. 1 and are shown in phantom lines. The other two slots are spaced near the end of the skirt 16. Also visible in FIG. 1 is a re-enforcement rib 26 which is connected to and extends beyond the flange 18 adjacent the slot 20. The rib 26 is used to strengthen the lid 10 in the area where the material for the slot 20 has been removed. The material of the lid 10 illustrated in FIG. 1 is preferably relatively thin, and re-enforcement is desirable. If a much thicker material is used, the rib 26 could be eliminated. Similar ribs 28 and 30 are also provided for the slots 22 and 24.

The dish member 12 in FIG. 2 includes a bottom panel 32 connected to an upstanding perimetric wall 34. The wall member terminates in an outwardly extending flange 36. The lid 10 and dish 12 are relatively sized so that the skirt 16 of the lid 10 will slide down over the flange 36 of the dish 12 when assembled. The flange 36 then rests on the underside of the top panel 14. This provides a relatively good seal configuration and aids in keeping the contents of the package warm — or cold, if such should be desired. The dish 12 also includes an outwardly extending locking tab 38, attached to the flange 36. The locking tab 38 is positioned to engage the slot 20 when the dish 12 and lid 10 are assembled. Two other locking tabs 40 and 42 also extend outward from the opposite side of the flange 36. The tabs 40 and 42 are positioned opposite the tab 38 and are located to engage slots 22 and 24. Located below the tab 38 is a pressure lock lug 44, whose function will now be discussed in detail. It should be observed that the precise position of tab 38 in a central location is not absolutely required. This tab, and the lock lug 44, could be positioned anywhere along the face of the package. Central positioning is preferred for the sake of symmetry and maximum locking forces.

If the pressure lock lug 44 were not used, an undesirable condition would result with respect to the assembled package. The locking tabs must be able to snap in and out of their respective slots rather easily to allow assembly and disassembly. The result of this fit is that if the package is picked up by the skirt 16, which is a natural grip, the locking tabs could slip out of their slots, due to the weight of the food in the dish 12, causing the dish 12 to fall. This type of failure is inherent in this design as soon as a critical weight of food in the dish 12 is exceeded. With very light food weights in the dish 12, this does not necessarily occur. However, beyond this point, the assembled package must be picked up by the bottom 32 or failure will occur. The horizontal force developed by the lug 44 reduces the required strength needed by the tabs 38, 40 and 42 which hold primarily by vertical forces. The use of the lug 44 therefore allows for lesser surface area and reduced thickness of the tabs 38, 40 and 42. This in turn allows for reduced weight of the entire package and reductions in the required sidewall thickness of the components thereof.

Figure 4:
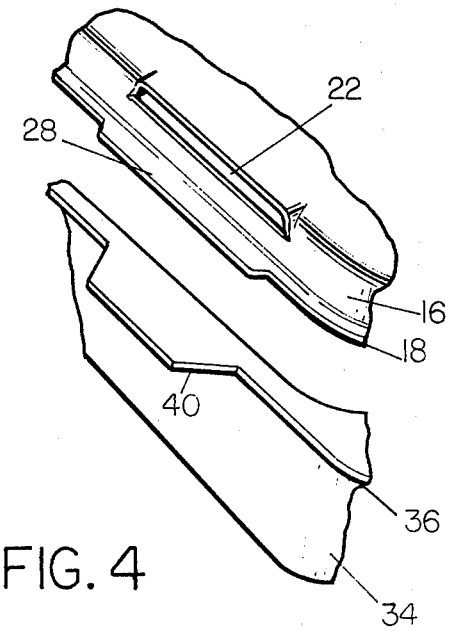
FIG. 4 is a partial perspective view, on an enlarged scale, of the lid and dish just prior to insertion of one of the two rear tabs into its mating slot.

In FIG. 4, the slot 22 and tab 40 are shown just prior to assembly. It can be appreciated that these elements must fit together with minimum effect to avoid overstressing their respective body members and to speed assembly. Likewise, too tight a fit would make removal very difficult, leading to consumer complaints.

Figure 6:
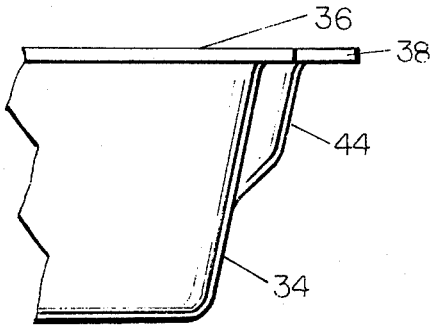
FIG. 6 is a partial side elevation view of the tray member of the present invention showing the locking lug.
Figure 5:
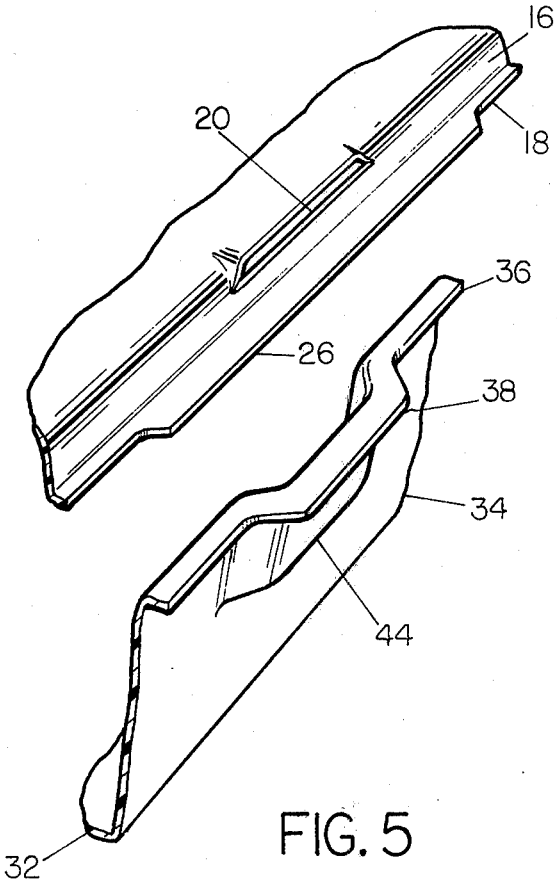
FIG. 5 is a partial perspective view, on an enlarged scale, of the lid and dish just prior to insertion of the single tab into its mating slot.

In contrast, the view of FIG. 5 shows the slot 20 and tab 38 just before assembly. Note that the pressure lock lug 44 is a rather large, outward projection, somewhat of an irregular rectangle in horizontal cross-section. The upper most edge of the pressure lock lug 44 merges with the under side of the tab 38. The pressure lock lug 44 extends outward beyond the flange 36 and has a dimension substantially as long as the tab 38. FIG. 6 further shows the size and outward projection of the pressure lock lug 44, relative to the tab 38 and flange 36.

Figure 7:
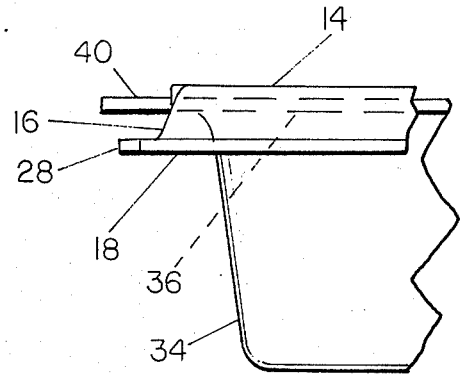
FIG. 7 is a partial side elevational view of the assembled package of the present invention showing the fit of one of the two rear tabs in its slot.

FIG. 7 shows how, when assembled, the flange 36 rests on the bottom of the top panel 14. The tab 40 extends smoothly through its mating slot 22. It may be seen that no undue stress is placed on either lid 10 or dish 12 by this particular fit. The tab 40 may be engaged by bowing the wall 34 slightly to allow it to enter the slot 22. It may be removed in the same fashion. However, as will be described, the tabs 40 and 42 are slipped into their slots 22 and 24 by holding the lid 10 at an angle. The tab 38 and slot 20 are then engaged with a snap.

Figure 8:
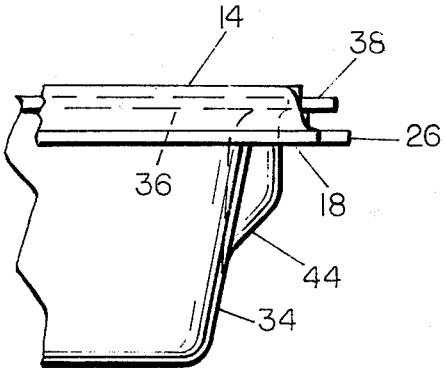
FIG. 8 is a partial side elevational view of the assembled package of the present invention showing the single tab fully inserted and the action of the locking lug.

FIG. 8 shows the interaction of the tab 38, slot 20, pressure lock lug 44 and flange 18. The pressure lock lug 44 extends slightly farther outward than does the bottom of the skirt 16 when the entire package is assembled. Note FIG. 7 again. The skirt 16 completely clears the flange 36, in FIG. 7 so there is no interference. Returning now to FIG. 8, the pressure lock lug 44 must be pressed inwardly enough, by pressing on the sidewall 34 directly under it, to allow the tab 38 to engage the slot 20. When pressure is released, the sidewall 34 comes back to its original shape with a snap. However, the pressure lock lug 44 is too large to allow the bottom of the skirt 16 to assume a free position as in FIG. 7. Instead, the pressure lock lug 44 and skirt 16 interfere with one another. The skirt 16, including the re-enforcement rib 26, is a relatively stiffer structure than the sidewall 34 of the dish 12. The dish sidewall 34 is bowed inwardly and its flange 36 locks into the corners of the lid 10 that are adjacent the pressure lock lug 44 on either side of it. This gives a three point wedge lock along the front edge of the assembled package. This overcomes the tendency of the slots to slip out when the package is lifted by the flange 18 when it contains a meal.

Figure 9:
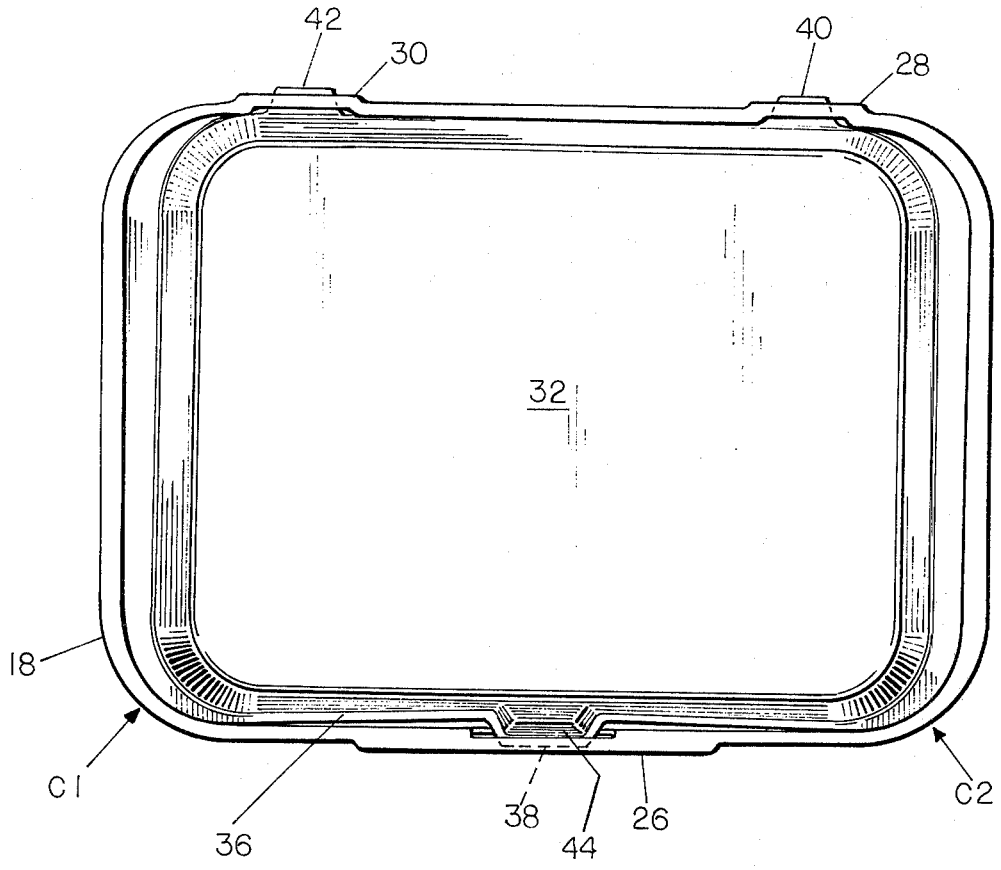
FIG. 9 is a bottom, plan view of the assembled package of the present invention showing the curvature of the dish member caused by the locking lug.

The bottom view of FIG. 9 perhaps best illustrates the locking function just described. The flange 36 and dish sidewall 34 exhibit a distinct bowed or curved outline from the pressure lock lug 44 toward corners designated as C1 and C2. The flange 36 clearly wedges into the corners C1 and C2 to provide a secure fit. To make the distinction even clearer, observe the flange 36 between the tabs 40 and 42 opposite the tab 38. There is no bow or distortion in the flange 36 in this area at all. It is the bend or bow to the sidewall 34 and flange 36 that gives the desired horizontal force component for carrying the load of any food in the package.

What I claim is:

1. A two piece food service package made of a relatively thin, flexible material which comprises, in combination:

A. a lid member, said lid member including; a top panel; a depending perimetric skirt attached to said top panel; an outwardly extending perimetric flange attached to the free end of said skirt; a first slot formed in said skirt; and second and third slots, formed in that portion of said skirt opposite said first slot; and B. a dish member, said dish member including; a bottom panel; an upstanding perimetric wall attached to said bottom panel; an outwardly extending perimetric flange attached to the free end of said perimetric wall, said dish flange having a perimetric configuration that will fit within the perimeter of said top panel, whereby said top panel will rest on said dish flange when said dish and lid are assembled; a first outwardly extending locking tab attached to the free edge of said dish flange and positioned to engage said first slot when ssaid lid is placed on said dish; second and third outwardly extending locking tabs attached to the free edge of said dish flange and positioned to respectively engage said second and third slots when said lid is placed on said dish; and a pressure lock lug positioned under said first locking tab and extending outwardly from said upstanding wall, the upper portion of said pressure lock lug merging with the lower portion of said first locking tab, said pressure lock lug extending outwardly further than said dish flange, whereby said pressure lock lug will bend said dish wall and dish flange to engage corners of said lid when said lid and dish are assembled.

2. The package of claim 1 wherein said lid member and said dish member are both made from a thermally insulating, foamed, thermoplastic material.

3. The package of claim 1 wherein said first slot is formed in said skirt in a substantially equidistant position from adjacent corners of said skirt.

4. The package of claim 2 wherein said lid member further includes a re-enforcement rib, connected to a free edge of said lid flange and extending outwardly therefrom, said rib being at least co-extensive with said first slot.

5. The package of claim 1 wherein said lid member further includes a pair of re-enforcement ribs, connected to a free edge of said lid flange and extending outwardly therefrom, one of said pair of ribs being at least co-extensive with said second slot and the other of said pair of ribs being at least co-extensive with said third slot.

* * * * *